US008813912B2

(12) United States Patent
Bennett et al.

(10) Patent No.: US 8,813,912 B2
(45) Date of Patent: Aug. 26, 2014

(54) PIVOT BLOCK CONNECTION

(75) Inventors: Ronald W. Bennett, Florence, SC (US); Sandy William Tyner, Hartsville, SC (US); Ellie Harold MacDonald, Timmonsville, SC (US)

(73) Assignee: Sam Carbis Asset Management, LLC, Florence, SC (US)

( * ) Notice: Subject to any disclaimer, the term of this patent is extended or adjusted under 35 U.S.C. 154(b) by 145 days.

(21) Appl. No.: 12/986,593

(22) Filed: Jan. 7, 2011

(65) Prior Publication Data

US 2012/0042458 A1 Feb. 23, 2012

Related U.S. Application Data

(63) Continuation-in-part of application No. 12/860,481, filed on Aug. 20, 2010, now Pat. No. 8,479,884.

(51) Int. Cl.
*E04G 5/14* (2006.01)
*B66F 11/04* (2006.01)

(52) U.S. Cl.
CPC ..... *B66F 11/04* (2013.01)
USPC ..... 182/113; 403/162

(58) Field of Classification Search
USPC ..... 182/141, 113; 403/162, 163
See application file for complete search history.

(56) References Cited

U.S. PATENT DOCUMENTS 2,684,734 A * 7/1954 Wilson ..... 188/74
3,067,835 A * 12/1962 Valley ..... 182/95
3,214,037 A * 10/1965 Schindler et al. ..... 414/389
4,136,622 A * 1/1979 Bue et al. ..... 108/48
4,679,657 A 7/1987 Bennett et al.
5,042,612 A 8/1991 Bennett et al.
5,392,878 A 2/1995 Bennett et al.
5,433,040 A * 7/1995 Morrison ..... 49/465
6,390,152 B1 5/2002 Donovan et al.
6,405,831 B1 6/2002 Daniel, III
6,502,267 B2 * 1/2003 MacDonald et al. ..... 14/69.5
6,527,081 B1 3/2003 Tyner et al.
6,814,522 B1 11/2004 Daniel, III
6,923,140 B1 8/2005 Cook
7,140,467 B2 11/2006 Cook
7,165,345 B2 * 1/2007 Beaudoin ..... 37/261
7,216,741 B2 * 5/2007 MacDonald et al. ..... 182/113
7,263,765 B1 * 9/2007 Smith et al. ..... 29/724
7,448,470 B2 11/2008 Brown et al.
7,832,525 B2 11/2010 Bennett et al.
8,261,882 B2 * 9/2012 Dangrow et al. ..... 182/204
2010/0307868 A1 12/2010 Bennett et al.

* cited by examiner

*Primary Examiner* — Alvin Chin-Shue
(74) *Attorney, Agent, or Firm* — Amy Allen Hinson; Nexsen Pruet, LLC

(57) ABSTRACT

A pivot block connection and assembly is disclosed. The pivot block assembly may include a pivot block connection and a gangway device having a stationary base and a pivotable access that is capable of being raised and lowered. The pivot block connection may include a first support body attached to a first side of the pivotable access, a first pivot bracket attached to the stationary base, and a first pivot rod spacer positioned between the first support body and the first pivot bracket. The pivot block connection may also include a second support body attached to a second side of the pivotable access, a second pivot bracket also attached to the stationary base, and a second pivot rod spacer positioned between the second support body and the second pivot bracket. A pivot rod may extend through the first pivot bracket, the first pivot rod spacer, the first support body.

26 Claims, 4 Drawing Sheets

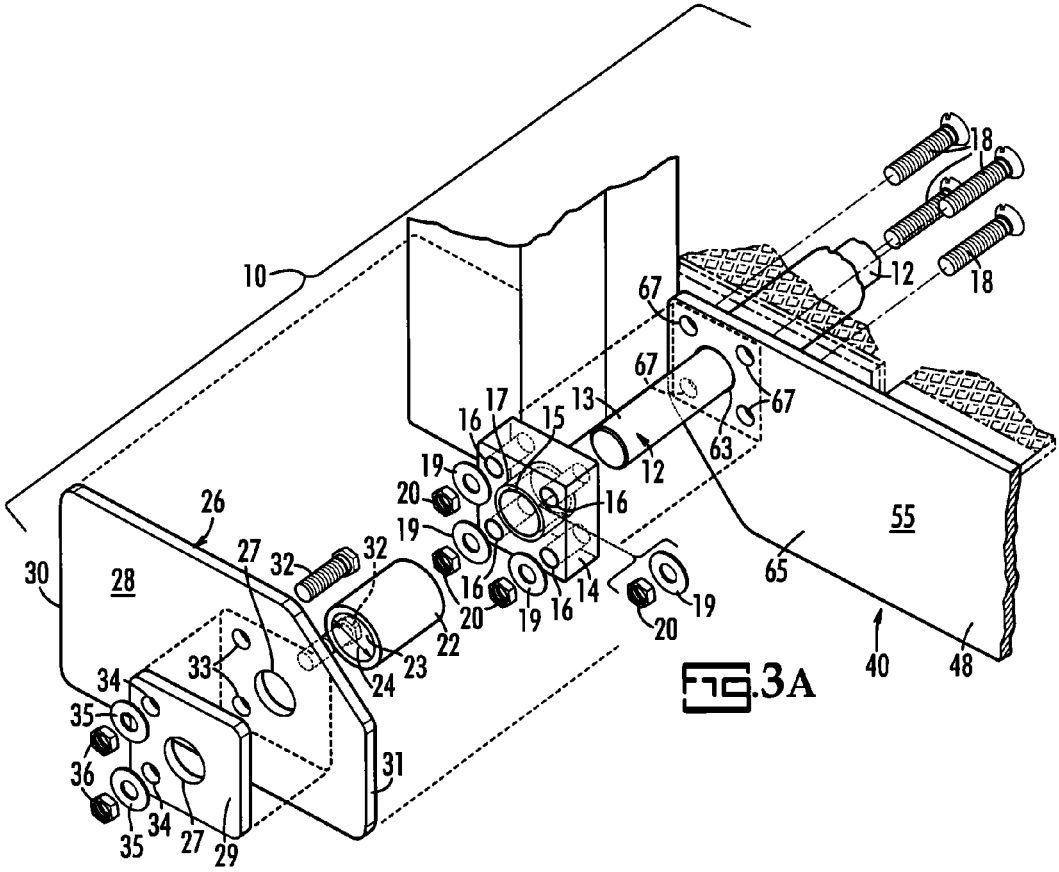
FIG. 3A
FIG. 3B
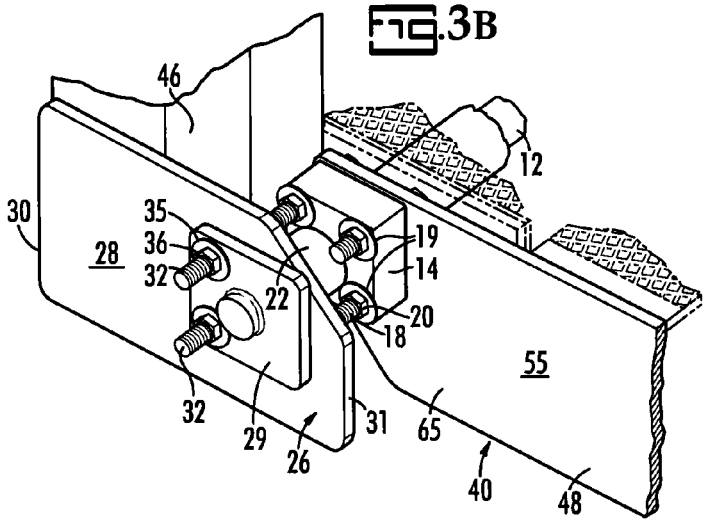

PIVOT BLOCK CONNECTION

CROSS REFERENCE TO RELATED APPLICATIONS

This application is a continuation-in-part application of pending U.S. patent application Ser. No. 12/860,481 filed Aug. 20, 2010 now U.S. Pat. No. 8,479,844 which is incorporated herein by reference.

BACKGROUND

The present invention discloses a pivot block assembly having a pivot block connection particularly suitable for use in connection with a pivotable gangway device.

A pivotable gangway device typically pivots between a raised stored position and a lowered service position to provide access to the upper surface of a container, such as a transport truck. Because the loads on pivotable gangway devices are frequently changing and increasing, increasing the durability without decreasing the functionality of pivotable gangway devices is desirable.

Thus there is a need in the art for a durable and functional pivotable gangway device that can withstand increasing loads.

SUMMARY

The present invention provides a pivot block connection and assembly. In one embodiment of the pivot block assembly, the assembly includes a gangway apparatus having a stationary base and a pivotable access wherein the pivotable access has a first side, an opposing second side, and an access way extending therebetween. The pivot access is capable of being raised and lowered. The pivot block assembly further includes a first support body attached to the first side of the pivotable access of the gangway apparatus. The first support body has a first opening extending therethrough. The pivot block assembly includes a first bracket having a first end and an opposing second end wherein the first end has a second opening extending therethrough and the opposing second end is attached to the stationary base of the gangway apparatus. The pivot block assembly also includes a first pivot rod spacer positioned between the first support body and the first bracket. The first pivot rod spacer has a third opening extending therethrough. The pivot block assembly includes a second support body attached to the second side of the pivotable access of the gangway apparatus. The second support body has a fourth opening extending therethrough. The pivot block assembly further includes a second bracket having a third end and a fourth opposing end wherein the third end has a fifth opening extending therethrough and the fourth opposing end is attached to the stationary base of the gangway apparatus. The pivot block assembly includes a second pivot rod spacer positioned between the second support body and the second bracket. The second pivot rod spacer has a sixth opening extending therethrough. The pivot block assembly also includes a pivot rod extending through the first side of the pivotable access, the first opening of the first support body, the third opening of the first pivot rod spacer, and the second opening of the first bracket.

In another embodiment of the pivot block assembly, the pivot block assembly includes a first support body for attachment to a pivotable device. The first support body has a first opening extending therethrough. The pivot block assembly further includes a first bracket having a first end and an opposing second end wherein the first end has a second opening extending therethrough. The pivot block assembly includes a first pivot rod spacer positioned between the first support body and the first bracket and wherein the first pivot rod spacer has a third opening extending therethrough. The pivot block assembly also includes a second support body for attachment to a pivotable device. The second support body has a fourth opening extending therethrough. The pivot block assembly includes a second bracket having a third end and a fourth opposing end wherein the third end has a fifth opening extending therethrough. The pivot block assembly includes a second pivot rod spacer positioned between the second support body and the second bracket and wherein the second pivot rod spacer has a sixth opening extending therethrough. The pivot block assembly includes a pivot rod extending through the first, second, third, fourth, fifth, and sixth openings.

In yet another embodiment of the pivot block assembly, the pivot block assembly includes a first support body for attachment to a pivotable device. The first support body has a first opening extending therethrough. The pivot block assembly also includes a first bracket having a first end and an opposing second end wherein the first end of the pivot block assembly has a second opening extending therethrough. The first bracket further includes a first inner plate and a first outer plate wherein the first outer plate is attached at the first end of the bracket to the first inner plate. The second opening of the first bracket extends through both the first inner plate and the first outer plate of the first bracket. The pivot block assembly includes a first pivot rod spacer positioned between the first support body and the first bracket. The first pivot rod spacer has a third opening extending therethrough. The pivot block assembly further includes a second support body for attachment to the pivotable device. The second support body has a fourth opening extending therethrough. The pivot block assembly includes a second bracket having a third end and a fourth opposing end wherein the third end has a fifth opening extending therethrough. The second bracket further includes a second inner plate and a second outer plate wherein the second outer plate is attached at the third end of the bracket to the second inner plate. The fifth opening of the second bracket extends through both the second inner plate and the second outer plate. The pivot block assembly includes a second pivot rod spacer positioned between the second support body and the second bracket. The second pivot rod spacer has a sixth opening extending therethrough. The pivot block assembly also includes a pivot rod extending through the first, second, third, fourth, fifth and sixth openings.

BRIEF DESCRIPTION OF THE DRAWINGS

FIG. 3A is an exploded perspective view of a pivot block connection affixed to a gangway device according to an embodiment of the present invention.

FIG. 3B is a perspective view of a pivot block connection affixed to a gangway device according to an embodiment of the present invention.

DESCRIPTION OF REPRESENTATIVE EMBODIMENTS

The present invention is related to a pivot block connection and assembly. The design and features of the pivot block connection when used in connection with a pivotable gangway device preferably allows for increased loads and increased durability of the pivotable gangway device. Although primarily described herein in terms of its use with pivotable gangway devices, it will be clear that the pivot block connection of the present invention may also be used in connection with a variety of other devices. The invention will be described with reference to the figures forming an integral nonlimiting part of the instant specification. Throughout the description, similar elements will be numbered accordingly.

Figure 1:
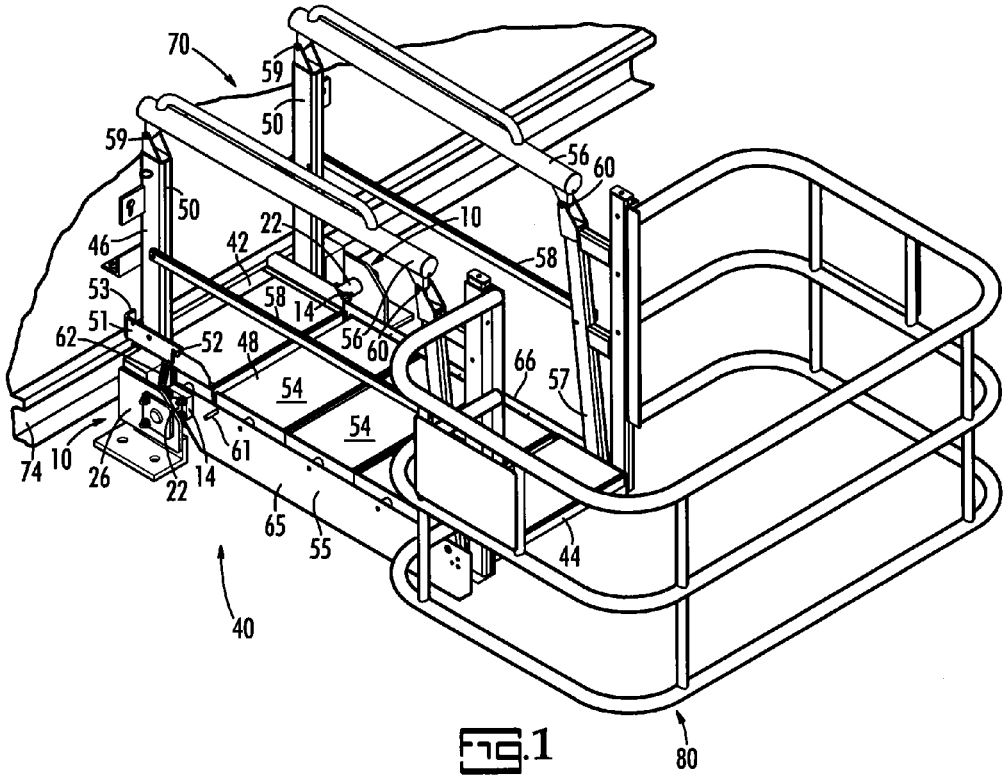
FIG. 1 is a perspective view of a pivot block assembly having a pivot block connection and a gangway device in the lowered service position according to an embodiment of the present invention.
Figure 2:
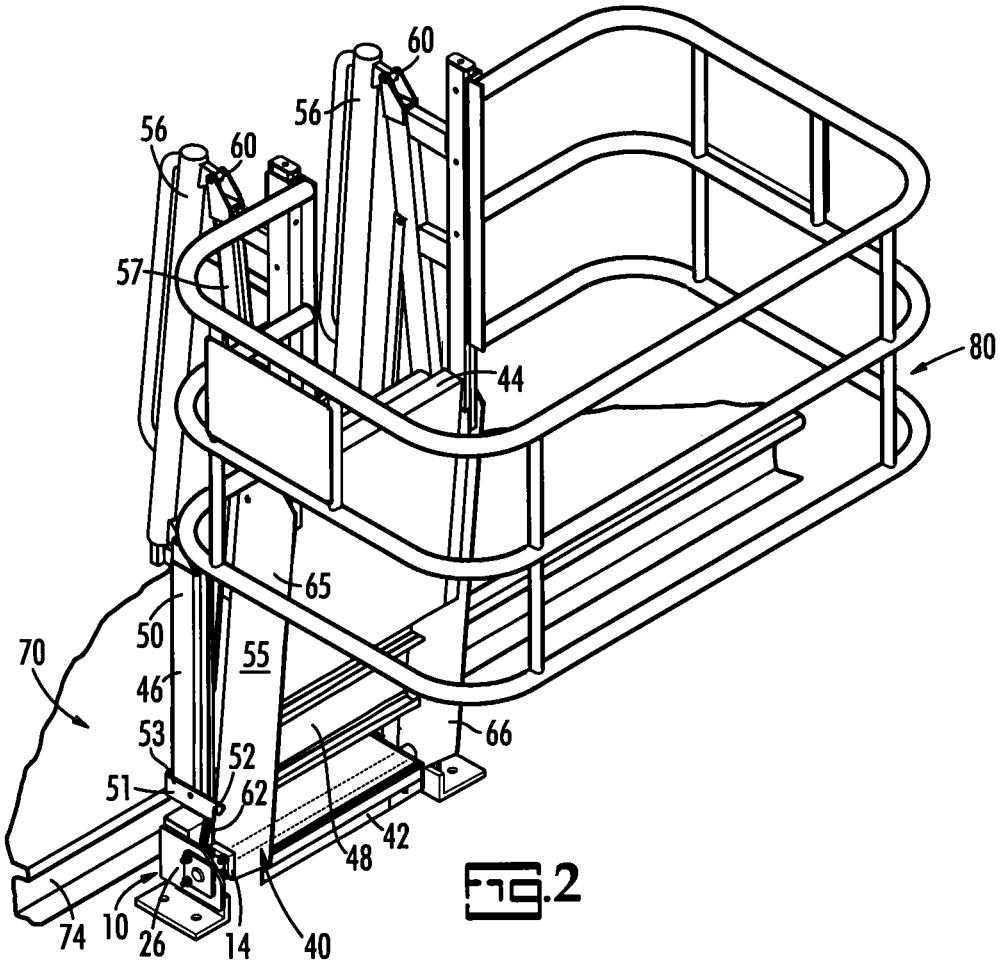
FIG. 2 is a perspective view of a pivot block assembly having a pivot block connection and a gangway device in the raised stored position according to an embodiment of the present invention.

FIG. 1 represents an embodiment of the pivot block connection 10 affixed to a gangway device 40. The gangway device 40 includes a first end 42 and a second end 44. The first end 42 of the gangway device 40 typically includes a stationary base 46 affixed to a platform 70. The gangway device 40 may also include a pivotable access 48 that pivots with respect to the stationary base 46 between a lowered service position and a raised stored position. FIG. 1 illustrates the pivotable access 48 of the gangway device 40 in a lowered service position. FIG. 2 illustrates the pivotable access 48 of the gangway device 40 in a raised stored position. In the shown embodiment, a safety cage 80 is attached to the second end 44 of the gangway device 40.

The stationary base 46 of the gangway device 40 may include rails 50 and a lock bar 51 that may be attached to a rail 50 as shown in FIGS. 1 and 2. In the embodiment shown, lock bar 51 is only located on one rail 50 but lock bar 51 may also be located on the other rail 50 without departing from the spirit and the scope of the present invention. The stationary base 46 may be bolted to a platform 70, such as by positioning stationary base 46 on top of platform 70. Alternatively, stationary base 46 may be slideably engaged with a track face 74 by rollers (not shown) attached to the stationary base 46, such as shown in U.S. application Ser. No. 12/860,481, which is incorporated herein. Other devices and techniques may be used for attaching the gangway device 40 to the platform 70 without departing from the spirit and the scope of the present invention.

The pivotable access 48 has a first side 65 and a second side 66 and may include a stringer 55 positioned on the first and second sides 65 and 66, respectively, of the pivotable access 48. Self-leveling steps 54 may be positioned between the first side 65 and second side 66 of the pivotable access 48 and attached to stringer 55. Alternatively or in addition to steps, the pivotable access 48 may include a ramp. To preferably provide added safety, the pivotable access 48 may also include handles 56, vertical members 57, and horizontal members 58. In the embodiment shown in FIGS. 1 and 2, handles 56 are pivotably attached to rails 50 of stationary base 46 at pivot points 59. Handles 56 are also pivotably attached to vertical members 57 at pivot points 60.

When a lock bar 51 is included on the stationary base 46 of the gangway device 40, stringer 55 of pivotable access 48 may also include a locking pin 61, such as shown in patent application Ser. No. 12/892,316 which is incorporated herein by reference, or other suitable member for locking the pivotable access 48 in the raised stored positioned. In the embodiment shown in FIGS. 1 and 2, locking pin 61 is only located on stringer 55 on the first side 65 of pivotable access 48 because a lock bar is only included on that side of gangway device 40. Locking pin 61 contacts opening 52 of lock bar 51 when the pivotable access 48 is raised. Opening 52, which is attached to spring 62 and pivotable about rail 50, raises upward until locking pin 61 is received within opening 52 of lock bar 51 as shown in FIG. 2. In this embodiment, pivotable access 48 is lowered by pressing down on pedal 53 of lock bar 51 so that locking pin 61 is no longer engaged with opening 52 and the pivotable access 48 can freely lower to the lowered service position as shown in FIG. 1.

As shown in FIGS. 1 and 2, the gangway device 40 may include a pivot block connection 10. Pivot block connection 10 may be affixed to gangway device 40 to secure pivotable access 48 to stationary base 46. Pivot block connection 10 may also allow pivotable access 48 to pivot with respect to stationary base 46 between the lowered service position and the raised stored position. Further, pivot block connection 10 may be affixed to gangway device 40 to provide load support for pivotable access 48.

The pivot block connection 10 preferably includes a pivot rod 12 that may extend across pivotable access 48 and through openings in the opposing sides 65 and 66 of pivotable access 48. In the embodiment shown in FIGS. 3A and 3B, pivot rod 12 extends through the first side of stringer 55, through or under steps 54 of pivotable access 48, and then through the other side of stringer 55. Pivot rod 12 may be a single unitary piece, such as shown in FIG. 2, or multiple pieces or rods. Pivot rod 12 may be cylindrical in shape and include an outer diameter 13.

The pivot block connection 10 also preferably includes a support body, such as pivot block 14 shown in FIGS. 3A and 3B. As shown in FIG. 1, a pivot block 14 may be secured to both sides 65 and 66 of pivotable access 48. Pivot block 14 preferably includes an opening 15 so that pivot rod 12 may extend therethrough. A sleeve or bearing 17 may also be inserted within opening 15 of pivot block 14, such as by press fitting bearing 17 into opening 15. Bearing 17 may reduce wear when rotation occurs between pivot rod 12 and pivot block 14. Pivot block 14 also may include openings 16 for securing pivot block 14 to pivotable access 48. Alternatively, other securing techniques and devices may be used for securing pivot block 14 to pivotable access 48. In the embodiment shown in FIGS. 3A and 3B, stringer 55 of pivotable access 48 includes openings 67 that align with the openings 16 of pivot block 14. Bolts 18 extend through the openings 67 of stringer 55, through openings 16 of pivot block 14, and are secured by washers 19 and collars, such as nuts, 20. In the embodiment shown, the pivot block is a quadrilateral shape and four bolts 18 are each positioned in the corners of the quadrilateral shaped pivot block 14. Alternatively, pivot block 14 may form other shapes such as an octagon or a pentagon. Moreover, the number of bolts and the positioning of the bolts may vary.

As shown in FIGS. 3A and 3B, the pivot block connection 10 also may include a pivot rod spacer 22. The pivot rod spacer may have an opening 23 with an inner diameter 24 that is preferably slightly greater than the outer diameter 13 of the pivot rod 12 so that pivot rod 12 can be inserted through pivot rod spacer 22. As shown in FIG. 1, a pivot rod spacer may be positioned on both sides 65 and 66 of pivotable access 48. In the embodiment shown in FIGS. 3A and 3B, pivot rod spacer may be positioned adjacent to support block 14.

The pivot block connection 10 also preferably includes a pivot bracket 26, such as shown in FIGS. 3A and 3B. As shown in FIG. 1, a pivot bracket 26 may be secured to both sides 65 and 66 of pivotable access 48. Pivot bracket 26 preferably includes an opening 27 so that pivot rod 12 may extend therethrough. In the embodiments shown in FIGS. 1, 2, and 3B, pivot bracket 26 is secured to stationary base 46 of gangway device 40. In one embodiment, pivot bracket 26 is secured to stationary base 46 by welding. In an alternative embodiment, pivot bracket 26 is secured to stationary base 46 by bolts.

In the embodiment shown in FIGS. 3A and 3B, pivot bracket 26 includes an inner plate 28 and an outer plate 29. In this embodiment, inner plate 28 may be attached at a first end 30 to stationary base 46 of gangway device 40 and outer plate 29 may be attached at the opposing second end 31 of inner plate 28. Outer plate 29 may be attached to inner plate 28 by bolts 32 extending through openings 33 of inner plate 28 and aligned openings 34 of outer plate 29. Bolts 32 may be secured by washers 35 and collars, such as nuts, 36, as shown in FIGS. 3A and 3B. Alternatively, other securing techniques and devices may be used for securing inner plate 28 to outer plate 29. In the embodiment shown, the inner plate 28 is a five-sided shape that forms a rectangle except that one corner is removed. The outer plate 29 of the shown embodiment is a quadrilateral shape and two bolts 32 are each positioned on the inside corners of the outer plate 29 so that the bolts 32 are near the center of the inner plate 28. Alternatively, the inner and outer plates, 28 and 29, respectively, may form other shapes. Moreover, the number of bolts and the positioning of the bolts may vary. Both inner plate 28 and outer plate 29 may include an opening 27 for pivot rod 12. In one embodiment, pivot rod 12 is positioned at opening 27 of outer plate 29 and welded to outer plate 29.

Figure 4:
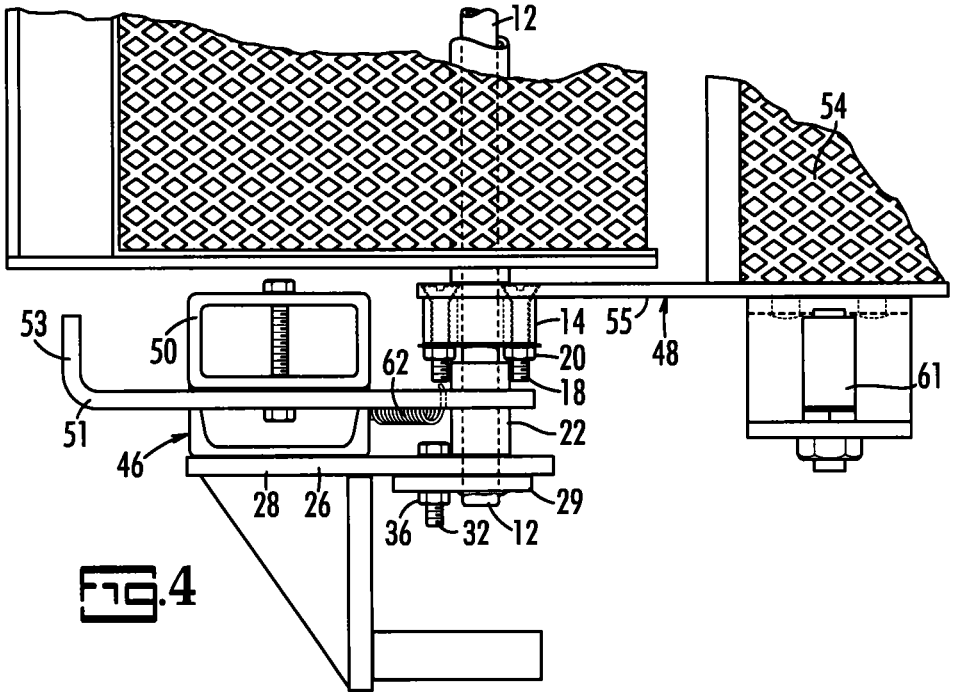
FIG. 4 is a top view of a pivot block connection affixed to a gangway device according to an embodiment of the present invention.

In the embodiment of FIGS. 3B and 4 showing side 65 of pivotable access 48, pivot rod 12 extends through opening 63 of stringer 55 of pivotable access 48, through opening 15 of pivot block 14, through opening 23 of pivot rod spacer 22, and through opening 27 of pivot bracket 26. Pivot rod 12 may also extend through opening 63 of stringer 55 of pivotable access 48, through opening 15 of pivot block 14, through opening 23 of pivot rod spacer 22, and through opening 27 of pivot bracket 26 on side 66 of pivotable access 48.

In one embodiment, pivot rod 12 is secured to pivot bracket 26 of pivot block connection 10 so that rotation is limited between pivot rod 12 and pivot bracket 26. For example and as shown in FIG. 3B, the end of pivot rod 12 and outer plate 29 of pivot bracket 26 may be secured, such as by welding. In this embodiment, pivotable access 48 and support block 14 rotate relative to and around pivot rod 12. A bearing 17 may be included in the opening 15 of pivot block 14 to reduce wear caused by the rotation between pivot rod 12 and pivot block 14.

In an alternative embodiment, pivot rod 12 is secured so that rotation is limited between pivot rod 12 and pivotable access 48. For example, pivot rod 12 may be secured, such as by welding, to stringer 55 or another portion of pivotable access 48. Alternatively, pivot rod 12 is secured to pivot block 14 of pivot block connection 10. In these embodiments, pivot rod 12 rotates relative to pivot bracket 26 of pivot block connection 10. A bearing (not shown) may be included in the opening 27 of pivot bracket 26 to reduce wear caused by the rotation of the pivot rod 12 on pivot bracket 26.

The pivot block connection 10 may be configured to attach to an existing gangway device using affixing techniques and mechanisms such as welding and bolts. Alternatively, pivot block connection 10 may be originally configured and formed with a new gangway device.

As discussed above, FIG. 1 illustrates an embodiment of the pivot block connection and assembly when the pivotable access 46 of the gangway device 40 is in the lowered service position. In this position, pivotable access 46 may be pivoted to an approximately horizontal direction. FIG. 2 illustrates an embodiment of the pivot block connection and assembly when the pivotable access 46 of the gangway device 40 is in the raised stored position. In this position, pivotable access 46 may be pivoted to an approximately vertical direction. Pivot block 14 of pivot block connection 10 rotates approximately 90 degrees from the position of pivot block 14 shown in FIG. 1 to the position of pivot block 14 shown in FIG. 2, while pivot bracket 26 stays in the same position. Furthermore, as shown in the embodiments of FIGS. 1 and 2, pivot bracket 26 of pivot block connection 10 is secured to the stationary base 46 on both sides of gangway device 40. Pivot rod 12 is inserted through opening 27 of pivot bracket 26, through opening 23 of pivot spacer 22, through opening 16 of pivot block 14, through opening 63 of stringer 55 on side 65 of pivotable access 48, under or through pivotable access 48, through opening 63 of stringer 55 on side 66 of pivotable access 48, through opening 16 of pivot block 14, through opening 23 of pivot spacer 22, and through opening 27 of pivot bracket 26.

It should be noted that there are several configurations of gangway devices and safety cages suitable for use with the pivot block connection without departing from the spirit and the scope of the present invention. It should also be noted that there are several configurations suitable for the design of the pivot block connection and assembly of the present invention, and the shapes and sizes of the parts of the pivot block connection and assembly discussed above are for example only and represent only some of the configurations of the pivot block connection and assembly. Other configurations altering the number of parts, attachment positions of the parts, means for attaching and securing the parts, and shapes, sizes, and dimensions of the parts could be employed to demonstrate the invention and are intended to be encompassed by the present invention. The description and drawings should not be deemed to narrow the scope of the present invention in any way.

While various embodiments of the present invention have been described above, it should be understood that they have been presented by way of example, and not limitation. It will be apparent to persons skilled in the relevant art(s) that various changes in form and detail can be made therein without departing from the spirit and scope of the present invention. In fact, after reading the above description, it will be apparent to one skilled in the relevant art(s) how to implement the invention in alternative embodiments. Thus, the present invention should not be limited by any of the above described exemplary embodiments.

In addition, it should be understood that the figures, which highlight the functionality and advantages of the present invention, are presented for purposes of example only. The architecture of the present invention is sufficiently flexible and configurable, such that it may be used in ways other than that shown in the accompanying figures.

Further, the purpose of the Abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The Abstract is not intended to be limiting as to the scope of the invention in any way.

What is claimed is:

1. A pivot block assembly comprising:

a first support block for attachment to a pivotable device, said first support block having a first opening extending therethrough;

a first bracket having a first end and an opposing second end, said first end having a second opening extending therethrough;

a first pivot rod spacer positioned between said first support block and said first bracket, wherein said first pivot rod spacer is directly adjacent to said first support block, said first pivot rod spacer having a third opening extending therethrough;

a second support block for attachment to said pivotable device, said second support block having a fourth opening extending therethrough;

a second bracket having a third end and a fourth opposing end, said third end having a fifth opening extending therethrough;

a second pivot rod spacer positioned between said second support block and said second bracket, wherein said second pivot rod spacer is directly adjacent to said second support block, said second pivot rod spacer having a sixth opening extending therethrough; and a pivot rod having a fifth end and an opposing sixth end, said first bracket adjacent to said fifth end and said second bracket adjacent to said sixth end, wherein said first and second support blocks are positioned therebetween, said pivot rod extending through said first, second, and third openings;

wherein said first support block further having a seventh opening adjacent to said first opening for rigid attachment of said first support block to said pivotable device, wherein a sleeve bearing is press fitted within the first opening to reduce wear due to rotation between the pivot rod and the first support block.

2. The assembly of claim 1 wherein said assembly further comprises said pivotable device, said pivotable device is rigidly attached between said first and second support blocks wherein rotation is limited between said support blocks and said pivotable device.

3. The assembly of claim 2 wherein said first and second support blocks are attached to said pivotable device by studs adjacent to said pivot rod and wherein at least one of said studs is inserted through said seventh opening.

4. The assembly of claim 3 wherein at least four studs surround said pivot rod at said first support block and at said second support block.

5. The assembly of claim 1 wherein said first bracket further comprises an inner plate and an outer plate.

6. The assembly of claim 5 wherein said outer plate is attached at said first end of said bracket to said inner plate and wherein said second opening extends through both said inner plate and said outer plate.

7. The assembly of claim 6 wherein said outer plate is attached to said inner plate by at least two studs adjacent to said pivot rod.

8. The assembly of claim 7 wherein said pivot rod is affixed to said outer plate of said first bracket and rotation is limited between said pivot rod and said outer plate.

9. The assembly of claim 1 wherein said pivotable device is a gangway apparatus, said gangway apparatus having a stationary base and a pivotable access, said pivotable access having a first side, an opposing second side, and an access way extending therebetween, said pivotable access capable of being raised and lowered.

10. The assembly of claim 9 wherein said first support block is attached to said first side of said pivotable access of said gangway apparatus, said opposing second end of said first bracket is attached to said stationary base of said gangway apparatus, said second support block is attached to said second side of said pivotable access of said gangway apparatus, and said fourth opposing end of said second bracket is attached to said stationary base of said gangway apparatus.

11. The assembly of claim 10 wherein when said pivotable access of said gangway is raised and lowered, said pivotable access rotates relative to said pivot rod.

12. The assembly of claim 11 wherein said pivot rod is affixed to said first bracket and rotation is limited between said pivot rod and said first bracket.

13. The assembly of claim 1 wherein said pivot rod further extends through said fourth, fifth, and sixth openings.

14. The assembly of claim 10 wherein said stationary base of said gangway apparatus further comprises a lock bar, said lock bar secures said pivotable access when said pivotable access is raised.

15. The assembly of claim 10 wherein said gangway apparatus further comprises a safety cage.

16. A pivot block assembly comprising:

a first support block for attachment to a pivotable device, said first support block having a first opening extending therethrough;

a first bracket having a first end and an opposing second end, said first end having a second opening extending therethrough, said first bracket further including a first inner plate and a first outer plate, said first outer plate is attached to said first inner plate, said second opening extends through both said first inner plate and said first outer plate;

a first pivot rod spacer positioned between said first support block and said first bracket, said first pivot rod spacer having a third opening extending therethrough;

a second support block for attachment to said pivotable device, said second support block having a fourth opening extending therethrough;

a second bracket having a third end and a fourth opposing end, said third end having a fifth opening extending therethrough, said second bracket further including a second inner plate and a second outer plate, said second outer plate is attached to said second inner plate, said fifth opening extends through both said second inner plate and said second outer plate;

a second pivot rod spacer positioned between said second support block and said second bracket, said second pivot rod spacer having a sixth opening extending therethrough; and a pivot rod extending through said first, second, third, fourth, fifth, and sixth openings;

wherein said pivot block assembly further comprises said pivotable device, said pivotable device comprises a stationary base and a pivotable access, said pivotable access having a first side, an opposing second side, and an access way extending therebetween, said pivotable access capable of being raised and lowered; and wherein said first support block is positioned adjacent to and between said first side of said pivotable access of said pivotable device and said first pivot rod spacer, said first support block rigidly attached to said first side of said pivotable access so that rotation is limited between said first support block and said pivotable access, and wherein said second support block is positioned adjacent to and between said second side of said pivotable access of said pivotable device and said second pivot rod spacer wherein a sleeve bearing is press fitted within the first and fourth openings to reduce wear due to rotation between the pivot rod and the support blocks.

17. The assembly of claim 16 wherein said second support block is rigidly attached to said pivotable device.

18. The assembly of claim 17 wherein said first and second support blocks are attached to said pivotable device by studs adjacent to said pivot rod wherein said first support block further having a seventh opening for insertion of at least one of said studs.

19. The assembly of claim 18 wherein at least four studs surround said pivot rod at said first support block and at said second support block.

20. The assembly of claim 16 wherein said pivot rod is affixed to said first outer plate of said first bracket and said second outer plate of said second bracket wherein rotation is limited between said pivot rod and said first and second outer plates.

21. The assembly of claim 20 wherein said pivot rod is welded to said first and second outer plates.

22. The assembly of claim 20 wherein said first support block includes a sleeve within said first opening.

23. The assembly of claim 16 wherein said first outer plate is attached to said first inner plate by at least two first studs adjacent to said pivot rod.

24. The assembly of claim 23 wherein said second outer plate is attached to said second inner plate by at least two second studs adjacent to said pivot rod.

25. The assembly of claim 16 wherein said opposing second end of said first bracket is attached to said stationary base of said pivotable device and said fourth opposing end of said second bracket is attached to said stationary base of said pivotable device.

26. A pivot block assembly comprising:

a pivotable device;

a first support block rigidly attached to said pivotable device, said first support block having a first opening extending therethrough;

a first bracket having a first end and an opposing second end, said first end having a second opening extending therethrough;

a first pivot rod spacer positioned between said first support block and said first bracket, wherein said first pivot rod spacer is directly adjacent to said first support block, said first pivot rod spacer having a third opening extending therethrough;

a second support block rigidly attached to said pivotable device, said pivotable device rigidly attached between said first and second support blocks wherein rotation is limited between said first and second support blocks and said pivotable device, said second support block having a fourth opening extending therethrough;

a second bracket having a third end and a fourth opposing end, said third end having a fifth opening extending therethrough;

a second pivot rod spacer positioned between said second support block and said second bracket, wherein said second pivot rod spacer is directly adjacent to said second support block, said second pivot rod spacer having a sixth opening extending therethrough; and a pivot rod extending through said first, second, and third openings wherein a sleeve bearing is press fitted within the first opening to reduce wear due to rotation between the pivot rod and the first support block.

* * * * *